US005637002A

United States Patent [19]

Buck et al.

[11] Patent Number: 5,637,002

[45] Date of Patent: Jun. 10, 1997

[54] SELF LOCKING AND EJECTING RJ-11 PLUG

[76] Inventors: Charles T. Buck, 2080 Indigo Ter.; Dennis L. Steffen, 340 Causeway Blvd. #201, both of Dunedin, Fla. 34698

[21] Appl. No.: 528,819

[22] Filed: Sep. 15, 1995

[51] Int. Cl.[6] ..... H01R 13/44

[52] U.S. Cl. ..... 439/148; 439/923

[58] Field of Search ..... 439/133, 135, 439/148, 676

[56] References Cited

U.S. PATENT DOCUMENTS

| | | | |
|---|---|---|---|
| 4,526,431 | 7/1985 | Kasukawa | 439/723 |
| 4,615,575 | 10/1986 | Kossor | 439/133 |
| 4,681,382 | 7/1987 | Hung et al. | 439/135 |
| 4,975,078 | 12/1990 | Stroede et al. | 439/405 |
| 5,044,981 | 9/1991 | Suffi et al. | 439/676 |
| 5,061,209 | 10/1991 | Bolick, Jr. et al. | 439/676 |
| 5,133,668 | 7/1992 | Brown, IV | 439/76 |
| 5,145,416 | 9/1992 | Cruise et al. | 439/668 |
| 5,340,333 | 8/1994 | Schroth | 439/607 |

*Primary Examiner*—Neil Abrams
*Assistant Examiner*—Barry Matthew L. Standig
*Attorney, Agent, or Firm*—Thomas, Kayden, Horstemeyer & Risley

[57] ABSTRACT

An RJ-11 jack, or plug, is described that is self-locking and has a self-ejecting feature. In particular, an RJ-11 jack is constructed with a tang on the rear lower portion of the RJ-11 jack in such a way that the tang is coupled to a locking tab of the RJ-11 jack. When inserted into an RJ-11 receptacle, or housing, the tang is compressed as a result of contact with an inside wall of the RJ-11 receptacle. The locking tab of the RJ-11 jack locks the RJ-11 jack into position with the tang compressed. The RJ-11 jack includes a tool access opening such that a tool, like a small screwdriver, can be inserted to press on a release tab, which is connected to the locking tab. When pressed, the applied force pushes up on the release tab, thereby moving up the locking tab and releasing the RJ-11 jack. The resultant decompression of the tang causes the RJ-11 jack to eject.

17 Claims, 5 Drawing Sheets

SELF LOCKING AND EJECTING RJ-11 PLUG

BACKGROUND OF THE INVENTION

The present invention relates to electrical connectors and, more particularly, to RJ-11 type connectors.

Today, an RJ-11 type housing, or receptacle, is familiar to everyone—it is the place where one "plugs in" one's telephone line, thereby coupling your telephone equipment or modem to the local-loop. Currently, an RJ-11 receptacle can be a 4, 6, or 8, position receptacle. For example, a 4 position RJ-11 receptacle has four metallic contacts that each provide access to, typically, a respective wire of a 4 wire cable.

Unfortunately, when nothing is plugged into the RJ-11 receptacle the metallic contacts are exposed—which exposes people to the voltage and current levels of any electrical signal present on each of the metallic contacts. This can be especially of concern in some countries outside of the United States, e.g., Great Britain, where 90 volts may be present on at least one of the metallic contacts within an RJ-11 receptacle.

As a result, some countries require that an used RJ-11 receptacle be covered or plugged to prevent inadvertent contact with any electrical signals within the receptacle by, e.g., small children. As a result, those in the art have developed approaches to cover or plug an unused RJ-11 receptacle.

One approach is to provide RJ-11 receptacles with a sliding door that slides over the RJ-11 receptacle opening when the RJ-11 receptacle is not in use. While preventing directs access to the inside of the RJ-11 receptacle, this approach unfortunately does not prevent someone from easily sliding the door open. In addition, this approach requires replacing pre-existing RJ-11 receptacles. That is, RJ-11 receptacles without sliding doors must be replaced with an RJ-11 receptacle with a sliding door.

Another approach is to use an "interference plug." The later is a "dust cover," e.g., a piece of molded, or formed, soft robber thin is pushed into the RJ-11 receptacle. While this approach can advantageously be used with any type of RJ-11 receptacle, the interference plug, like the sliding door approach described above, is easy to remove.

Finally, a practical, albeit imperfect approach, is to use a corresponding RJ-11 jack, or plug, that is modified in the field to not have any wires and where the removal tab is shortened, or broken off. While this approach effectively locks the modified RJ-11 jack into the RJ-11 receptacle it is difficult to remove and aesthetically lacking. Indeed, the difficulty of removal is directly related to how much of the removal tab is broken off. As a result, this approach is not user-friendly.

SUMMARY OF THE INVENTION

In accordance with the invention, we have developed an RJ-11 jack, or plug, that is self-locking and has a self-ejecting feature.

In an embodiment of the invention, an RJ-11 jack, or telephone connector, is constructed with a tang on the rear lower portion of the RJ-11 jack in such a way that the tang is coupled to a locking tab of the RJ-11 jack. When inserted into an RJ-11 receptacle, or housing, the tang is compressed as a result of contact with an inside wall of the RJ-11 receptacle. The locking tab of the RJ-11 jack locks the RJ-11 jack into position with the tang compressed. The RJ-11 jack includes a tool access opening such that a tool, like a small screwdriver, can be inserted to press on a release tab, which is connected to the locking tab. When pressed, the applied force pushes up on the release tab, thereby moving up the locking tab and releasing the RJ-11 jack. The resultant decompression of the tang causes the RJ-11 jack to eject.

As a result, our design provides an RJ-11 jack, or plug, that locks into position, must be tool operated to remove, and also has a user-friendly self-ejecting feature for convenient removal.

DETAILED DESCRIPTION

Figure 1A:
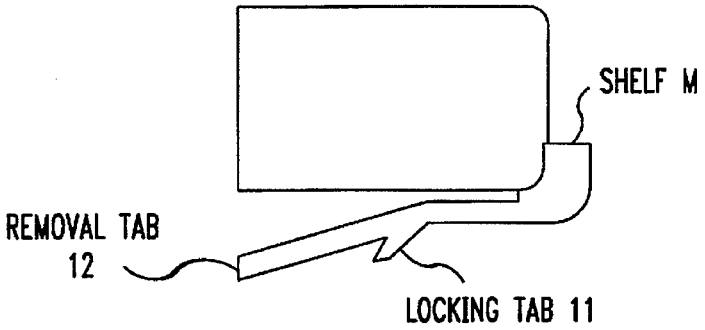
FIGS. 1A and 1B show an illustrative prior art RJ-11 type plug.
Figure 1B:
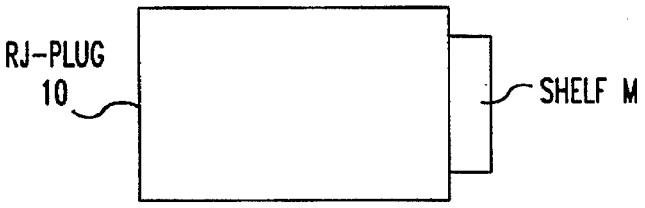
(PRIOR ART) FIG. 1B

A general representation of a prior art RJ-11 type plug, RJ-11 plug 10, is shown in FIGS. 1A and 1B for reference. FIG. 1A is a side-view of the shape of RJ-11 plug 10. In particular, FIG. 1A shows that RJ-11 plug 10 includes a release tab 12, locking tab 11, and shelf 14. The latter provides an offset that fits into a corresponding inset with an RJ-11 receptacle (not shown). This allows for proper seating to facilitate connection of any metallic contacts (not shown) within RJ-11 plug 10 to corresponding metallic contacts in the RJ-11 receptacle (not shown). Shelf 14 is solid and extends across most of the width of RJ-11 plug 10 as illustrated in FIG. 1B, which is a top-view of RJ-11 plug 10.

Figure 2:
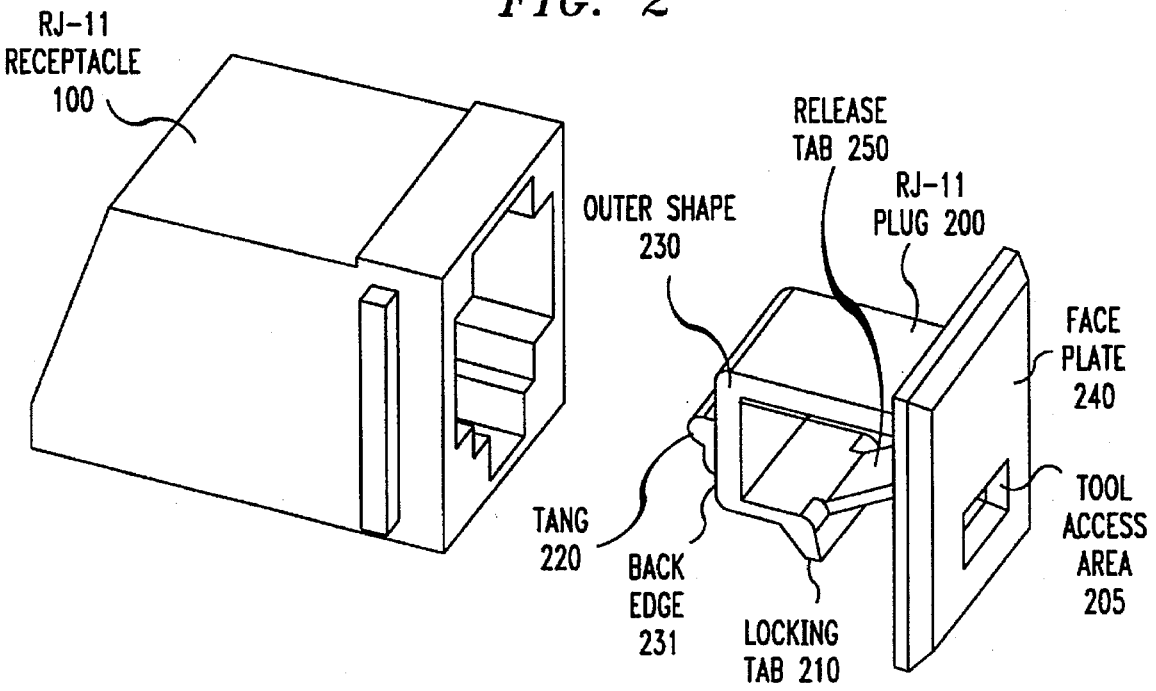
(PRIOR ART) FIG. 2
FIG. 2 shows a connector arrangement in accordance with the principles of the invention.

A connector arrangement in accordance with the principles of the invention is shown in FIG. 2. Other than the inventive concept, the ability to fabricate an RJ-11 type receptacle and plug is well-known and will not be described. RJ-11 receptacle 100 is representative of a standard 6 position RJ-11 receptacle. For the purposes of this description, only a 6 position RJ-11 receptacle is described, however, the inventive concept easily extends to any size RJ-11 type receptacle irrespective of the number of positions within the RJ-11 type receptacle. In addition, whether RJ-11 receptacle 100 is wall-mounted or mounted within equipment is irrelevant to the inventive concept.

In accordance with the invention, RJ-11 plug 200 comprises an outer shape 230, tang 220, locking tab 210, release tab 250, and faceplate 240. Outer shape 230 conforms to the inside shape of RJ-11 receptacle 100. Molded to back edge 23 1 of outer shape 230 is illustrative tang 220. Outer shape 230 further includes locking tab 210, which is molded with back edge 231. Other than the inventive concept, locking tab 210 functions as in the prior art when plugged into receptacle 100. However, and in accordance with the principles of the invention, release tab 250 is molded to locking tab 210 in such a way that it is contained within RJ-11 plug 200. The latter is covered by faceplate 240 which is molded to outer shape 230. Faceplate 240 includes tool access area 205, which is used to provide access to release tab 250.

Figure 3A:
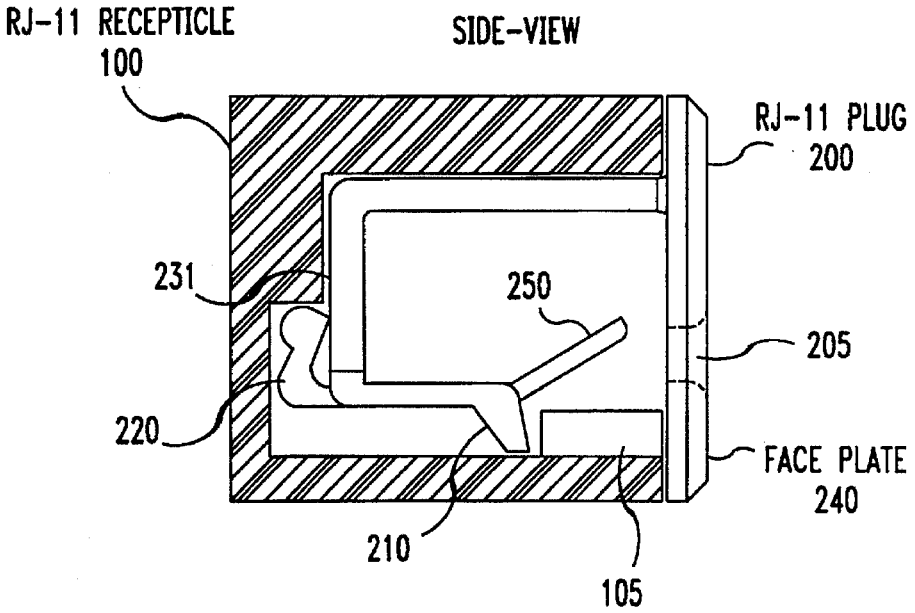
FIGS. 3A and 3B illustrate operation of the inventive concept.
Figure 3B:
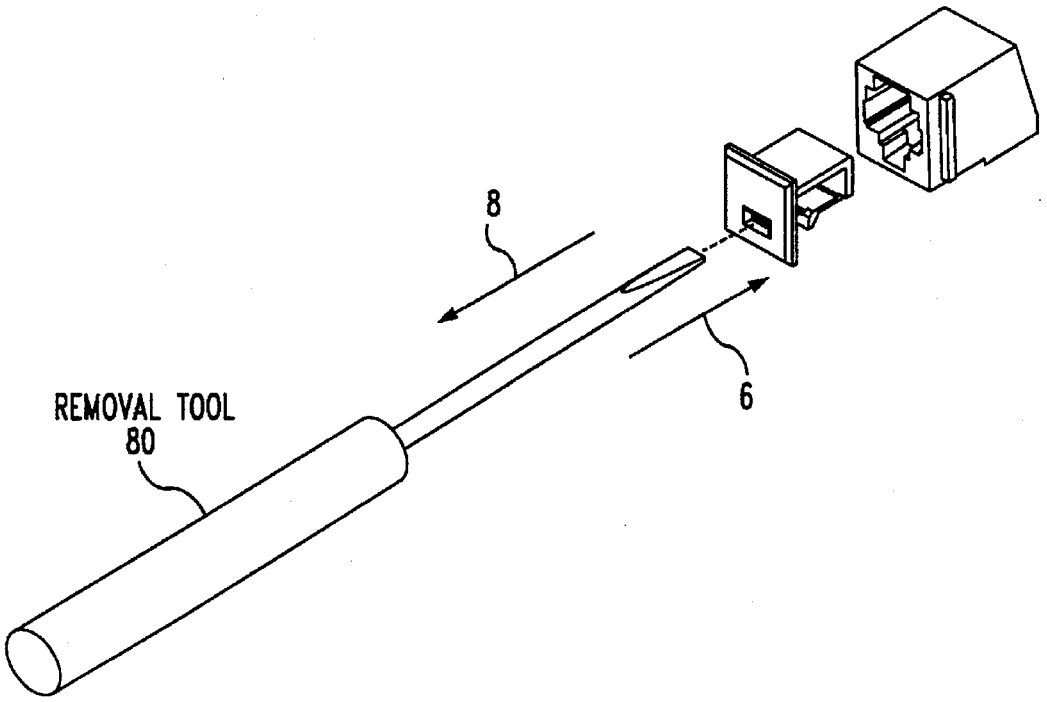

FIGS. 3A to 3B illustrate the inventive concept. As can be observed from FIG. 3A, RJ-11 plug 200 is fully inserted into RJ-11 receptacle 100. As a result, locking tab 210 is behind shelf 105, as known in the art. Also shown in FIG. 3A, and in accordance with the principles of the invention, is tang 220, which is compressed in the direction of back edge 231 as a result of the insertion of RJ-11 plug 200 into RJ-11 receptacle 100. This compression of tang 220 creates a positive pressure in the direction of, i.e., back towards, faceplate 240. (As noted above, RJ-11 200 is held in place by locking tab 210.)

Locking tab 210 is released by application of appropriate force on release tab 250. This is shown in FIG. 3B. Release tool 80, e.g., a small screwdriver, is inserted into tool access area 205 to make contact with and push up release tab 250 in an upward direction illustrated by arrow 6. This results in lifting locking tab 210 above shelf 105 of RJ-11 receptacle 100. Once locking tab 210 is above shelf 105, RJ-11 plug 200 is no longer locked. As a result, the above-mentioned positive pressure exerted by tang 220 pushes RJ-11 plug 200 out of RJ-11 receptacle 100 in the direction indicated by arrow 8.

As a result, our design provides an RJ-11 jack, or plug, that locks into position, must be tool operated to remove, and also has a user friendly self-ejecting feature for convenient removal. The self-ejecting mechanism described above is activated, as a result, by any pointed tool or thin object with a point, such as a pencil, being inserted into tool access area 205.

In addition, this design provides a convenient and easy to use RJ-11 plug for covering unused RJ-11 receptacles located on equipment. For example, often different versions of modem equipment are manufactured with one, two, or more, RJ-11 receptacles. For the purposes of this illustration assume a modem with one RJ-11 receptacle is called product "A," while a modem with two RJ-11 receptacles is called product "B." Although these modems may be programmed differently to offer different features, the electrical components oftentimes are the same. However, since product A is only intended to use one RJ-11 receptacle a physically different housing is manufactured for product A than for product B, which has a housing to support two RJ-11 receptacles. The use of a different housing for product A provides a user of product A with only one choice of which RJ-11 receptacle to use. (If there were two open RJ-11 receptacles on product A, the user may inadvertently choose the wrong one). However, use of an RJ-11 plug in accordance with the principles of this invention allows one housing to be used—which can result in significant savings on a production line. In this example, the housing of product B can also be used for product A, with the unused RJ-11 receptacle conveniently blocked by an RJ-11 plug that is self-locking with tool operated and self ejecting features. This not only prevent a user of product A from using the wrong RJ-11 receptacle but also protects the equipment coupled to the metallic contacts of the unused RJ-11 receptacle from inadvertent shorts, etc.

Figure 4A:
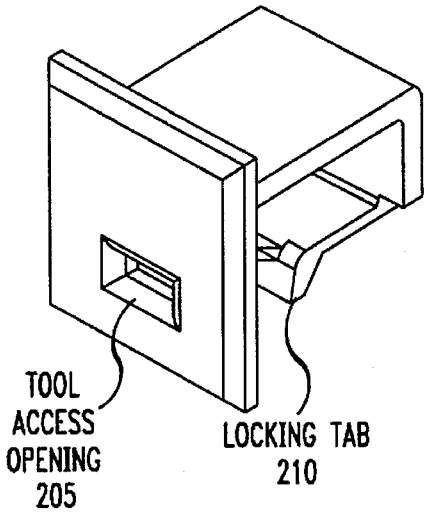
FIGS. 4A and 4B show other illustrative views of an RJ-11 plug in accordance with the principles of the invention.
Figure 4B:
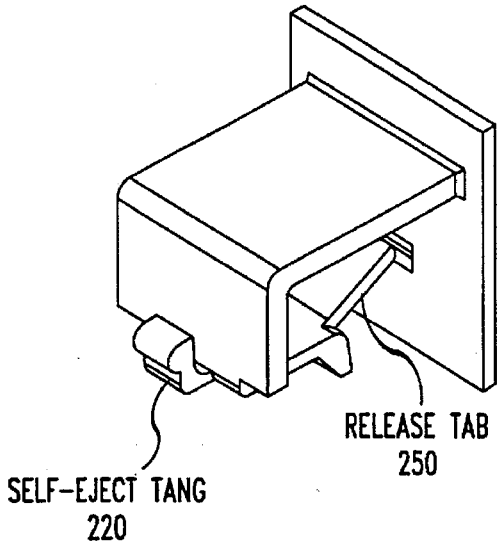
Figure 5A:
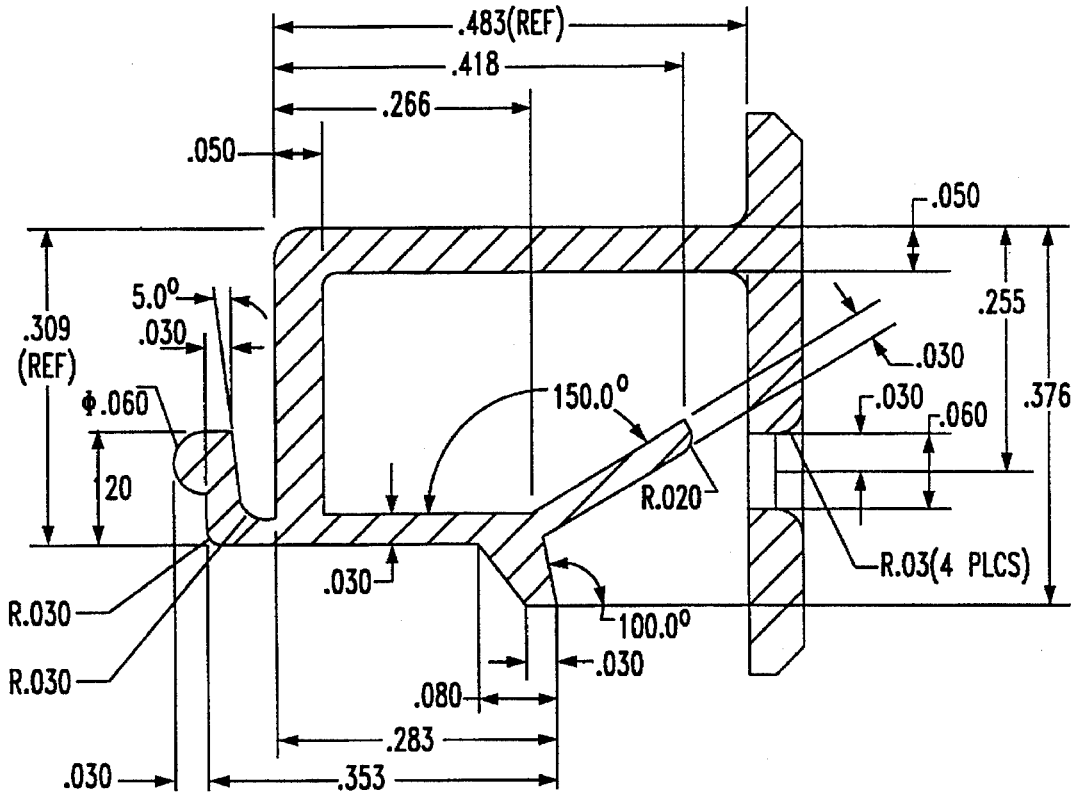
FIGS. 5A through 5E show illustrative engineering drawings of an RJ-11 plug in accordance with the principles of the invention.
Figure 5B:
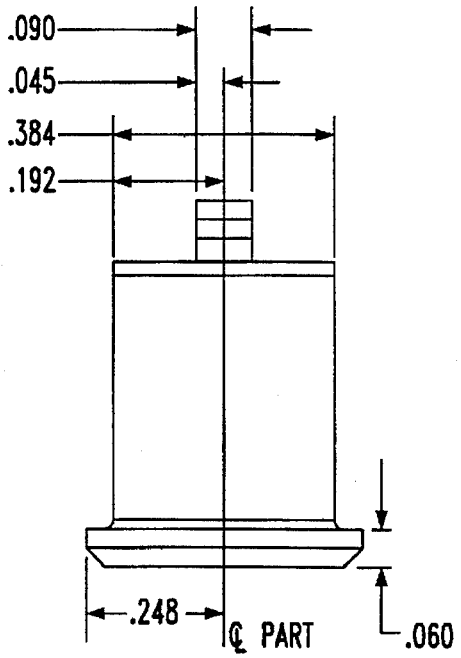
Figure 5C:
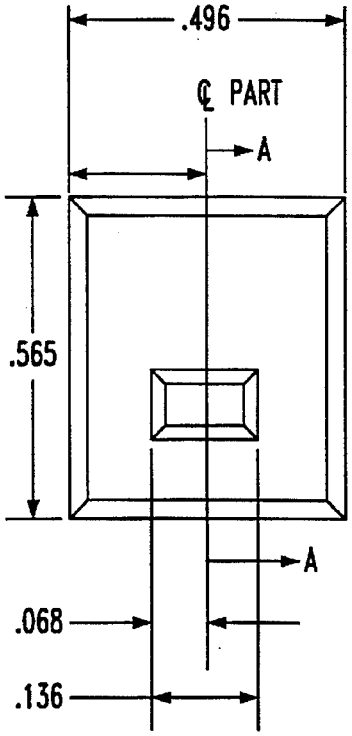
Figure 5D:
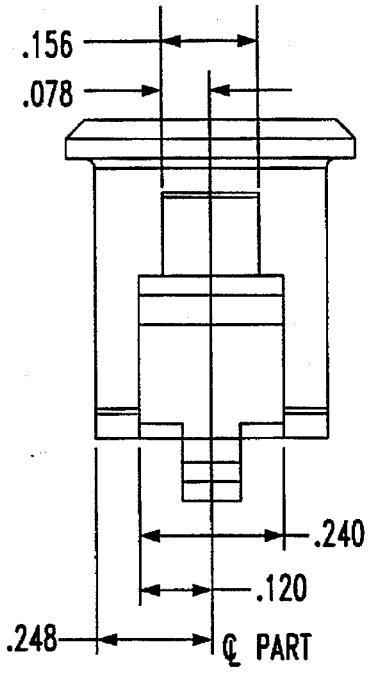
Figure 5E:
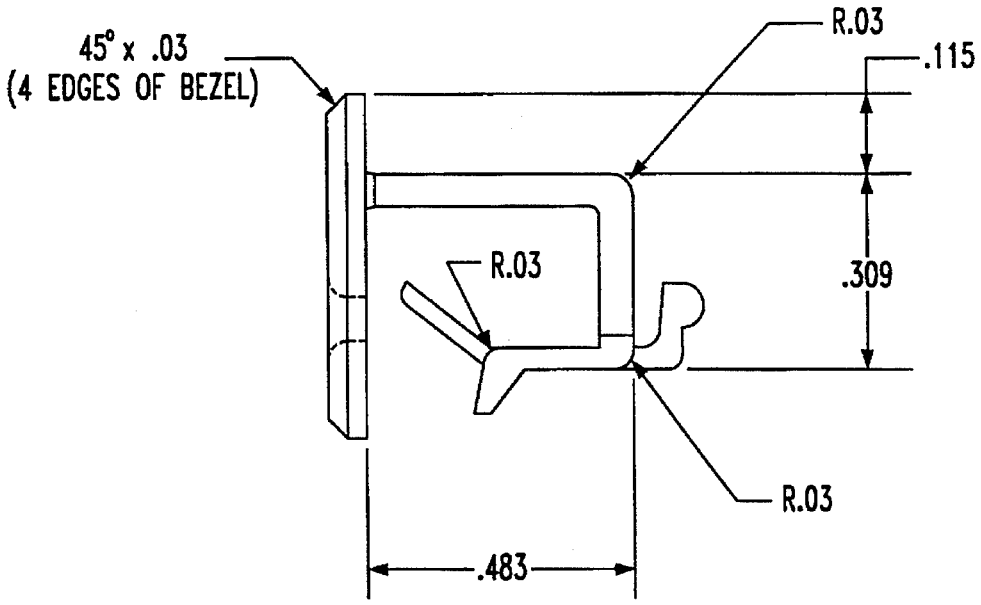

FIGS. 4A and 4B show two other isometric views of RJ-11 plug 200. FIGS. 5A through 5E show illustrative engineering drawings on the specifications of RJ-11 plug 200. All dimension techniques represented in FIGS. 5A through 5E are in accordance with ANSI standard Y14 dimensioning practice. In addition, the following terms, like "draft," "gating," "fillets," etc., are known to one skilled in the art. The material used to manufacture RJ-11 plug 200 is illustratively GE "Lexan" BE1130 (a polycarbonate) at a minimum thickness of 0.030 inches. The inside draft angle should be 1 degree +/–one half of a degree. The outside draft angle is 3 degrees+/–one half of a degree. The inside fillets and radius should be 0.010 R. The outside fillets and radius should be 0.030 R. It is recommended that all textured surfaces have an SPI/SPE#3 or finer finish. Similarly, it is recommended that all weld and or knit lines should be minimized. All external dimensions affected by draft apply at the large end of the feature. All internal dimensions affected by draft apply at the small end of the feature. All comers shown sharp may be rounded to 0.010 R maximum. A gate is to be milled flush with emanating surface to +/–0.003 inches.

The foregoing merely illustrates the principles of the invention and it will thus be appreciated that those skilled in the art will be able to devise numerous alternative an arrangements which, although not explicitly described herein, embody the principles of the invention and are within its spirit and scope.

For example, although the invention is illustrated herein as being used to cover RJ-11 receptacles, it does not matter where the RJ-11 receptacle is mounted, whether this be in a wall, equipment, etc. In addition, the design of the tang may vary as a function of the material used to manufacture the RJ-11 plug. Also, the inventive concept is applicable to other forms of telephone connectors.

What is claimed:

1. An improved telephone connector for insertion into a corresponding telephone connector housing, wherein the improvement comprises:

self-ejector means that makes contact with an inner surface of the telephone connector housing for automatically ejecting the improved telephone connector from the telephone connector housing when a locking tab of the improved telephone connector is released.

2. The apparatus of claim 1 wherein the inner surface of the telephone connector housing is opposite an opening of the telephone connector housing through which the improved telephone connector is inserted.

3. The apparatus of claim 1 wherein the ejector means is a tang molded onto a rear surface of the improved telephone connector in such a way that the tang is compressed by contact with the inner surface of the telephone connector housing when the improved telephone connector is locked into the telephone connector housing.

4. The apparatus of claim 1 wherein the telephone connector housing is an RJ-11 type housing.

5. The apparatus of claim 1 wherein the improved telephone connector further comprises:

a faceplate having an access hole; and a release tab connected to the locking tab and disposed within the improved telephone connector in such a way to be operated by insertion of a tool through the access hole.

6. The apparatus of claim 5 wherein the faceplate covers the telephone connector housing when the improved telephone connector is inserted therein.

7. A protective cover and telephone connector for insertion into a corresponding telephone receptacle, the protective cover and telephone connector comprising:

a locking tab molded to a bottom surface of the telephone connector for locking the telephone connector into the telephone receptacle when the telephone connector is inserted into the telephone receptacle;

a release tab molded to a top surface of the locking tab and disposed within a cavity of the telephone connector;

a tang molded to a back surface of the telephone connector in such a way that the tang is compressed when the telephone connector is locked into the telephone receptacle; and a faceplate having a hole for covering the cavity, where the face plate is molded to a front portion of the telephone connector and the hole allows a tool inserted therein to have contact with the release tab.

8. The apparatus of claim 7 wherein the tang is compressed as a result of contact with an opposing inner surface of the telephone receptacle and wherein the tang is maintained in a compressed state when the locking tab locks the telephone connector into the telephone receptacle.

9. The apparatus of claim 8 wherein the release tab operates the locking tab in such a way to unlock the telephone connector wherein the compressed tang decompresses causing the ejection of the telephone connector from the telephone receptacle.

10. The apparatus of claim 9 wherein the release tab operates the locking tab in response to a force applied by the tool.

11. The apparatus of claim 7 wherein the faceplate covers the telephone receptacle when the telephone connector is locked into the telephone receptacle.

12. The apparatus of claim 7 wherein the telephone receptacle and the telephone connector are an RJ-11 telephone receptacle and an RJ-11 telephone connector, respectively.

13. An improved modular jack for insertion into an modular receptacle wherein the improvement comprises self-ejector mechanism for automatically ejecting the improved modular jack from the modular receptacle upon release of a locking tab of the improved modular jack.

14. The apparatus of claim 13 wherein the ejector mechanism is a tang molded onto a rear surface of the improved modular jack in such a way that the tang is compressed when the improved modular jack is locked into the modular receptacle.

15. The apparatus of claim 13 wherein the improved modular jack and the modular receptacle conform to RJ-11.

16. A protective cover for a modular receptacle having an inner housing comprising:

a modular plug for insertion into the receptacle;

a resilient compression tang carried on the modular plug, the compression tang configured to engage an inner housing of the receptacle in response to insertion of the plug into the plug;

a locking tab carried on the modular plug and responsive to the compression of the compression tang to project outwardly from the plug and form an interference fit with the inner housing, the compression of the compression tang urging the locking tab against the inner housing;

a release tab connected to the locking tab; and a faceplate attached to the plug and configured to substantially cover the receptacle when the plug is inserted therein, the faceplate further including an access window disposed substantially coincident with the release tab;

whereby a release tool may be inserted through the access window to deflect the release tab, and thereby urge the locking tab away from the inner housing to defeat the interference fit, wherein the plug is then motivated to eject from the socket due to the resilience of the compression tang.

17. The protective cover as defined in claim 16, wherein the modular receptacle is an RJ-11 type receptacle.

* * * * *

UNITED STATES PATENT AND TRADEMARK OFFICE

CERTIFICATE OF CORRECTION

PATENT NO. : 5,637,002

DATED : June 10, 1997

INVENTOR(S) : Charles T.Buck, Dennis L. Steffen

It is certified that error appears in the above-indentified patent and that said Letters Patent is hereby corrected as shown below:

On the title page,
under References Cited, U.S. Patent Documents:

Delete "4,681,382", insert --4,681,383--

Signed and Sealed this

Ninth Day of June, 1998

*Attest:*

Bruce Lehman

BRUCE LEHMAN

*Attesting Officer*

*Commissioner of Patents and Trademarks*